US009695033B1

(12) United States Patent
Alshouse et al.

(10) Patent No.: US 9,695,033 B1
(45) Date of Patent: Jul. 4, 2017

(54) SYSTEM FOR DISPENSING CUSTOM BLENDED ELECTRONIC CIGARETTE LIQUID

(71) Applicants: Andrew Alshouse, Champlin, MN (US); Brandon Alshouse, Champlin, MN (US)

(72) Inventors: Andrew Alshouse, Champlin, MN (US); Brandon Alshouse, Champlin, MN (US)

( * ) Notice: Subject to any disclaimer, the term of this patent is extended or adjusted under 35 U.S.C. 154(b) by 186 days.

(21) Appl. No.: 14/517,448

(22) Filed: Oct. 17, 2014

Related U.S. Application Data

(60) Provisional application No. 61/892,020, filed on Oct. 17, 2013.

(51) Int. Cl.

| | |
|---|---|
| ***B67D 7/06*** | (2010.01) |
| ***B67D 7/56*** | (2010.01) |
| ***B67D 7/30*** | (2010.01) |
| ***A24B 13/00*** | (2006.01) |
| ***A24B 15/18*** | (2006.01) |

(52) U.S. Cl.
CPC ..... *B67D 7/302* (2013.01); *A24B 13/00* (2013.01); *A24B 15/18* (2013.01)

(58) Field of Classification Search
CPC .. B67D 1/0003; B67D 1/0034; B67D 1/0027; B67D 1/0015; B67D 1/0016; B67D 1/0017; B67D 7/302; B05B 11/3081; A24B 13/00; A24B 15/18; B65B 3/12; A24F 47/00; A24F 47/002
USPC ..... 222/129.4, 23, 144.5, 129.1, 129, 132, 222/135, 129.3; 700/231, 233, 239
See application file for complete search history.

(56) References Cited

U.S. PATENT DOCUMENTS

| | | | | |
|---|---|---|---|---|
| 3,655,097 | A | 4/1972 | Booth et al. | |
| 4,708,266 | A * | 11/1987 | Rudick | B67D 1/0036 222/105 |
| 4,753,370 | A * | 6/1988 | Rudick | B67D 1/0051 222/105 |
| 5,119,836 | A | 6/1992 | White | |
| 5,242,081 | A | 9/1993 | van der He den et al. | |

(Continued)

FOREIGN PATENT DOCUMENTS

| | | | |
|---|---|---|---|
| WO | 8502325 | A1 | 6/1985 |
| WO | 2010020258 | A1 | 2/2010 |
| WO | 2013050934 | A1 | 4/2013 |

*Primary Examiner* — J. Casimer Jacyna
*Assistant Examiner* — Benjamin R Shaw
(74) *Attorney, Agent, or Firm* — Westman, Champlin & Koehler, P.A.; Z. Peter Sawicki; Amanda M. Prose

(57) ABSTRACT

A system for accurately dispensing small amounts of custom blended liquids for vaporizing in an electronic cigarette device comprising a plurality of interactive display devices; a controller for relaying input from a first interactive device to a second and a third interactive device and a liquid dispenser. The dispenser in electronic communication with the second interactive device and controller and comprising a plurality of containers for holding liquids; a plurality of spouts, each spout for dispensing the liquids as a mixture; and a plurality of pumps for moving the liquids from the containers to the spouts. A plurality of calibrated delivery devices for further custom blending the liquid by addition of a liquid flavoring can also be used. The liquid dispenser is configured to eliminate cross-contamination of components when dispensing.

13 Claims, 13 Drawing Sheets

(56) References Cited

U.S. PATENT DOCUMENTS 5,497,914 A * 3/1996 Maltsis ..... B08B 3/026 222/135
5,868,177 A * 2/1999 Leahy ..... B67D 7/743 141/104
6,062,425 A 5/2000 Brown et al.
6,269,831 B1 8/2001 Blair, Jr. et al.
7,624,895 B2 * 12/2009 Haskayne ..... B67D 1/0021 222/129.1
8,020,566 B2 9/2011 Karles et al.
8,430,106 B2 4/2013 Potter et al.
2003/0168472 A1 * 9/2003 Segiet ..... B67D 1/0029 222/129.1
2007/0068969 A1 * 3/2007 Orzech ..... B67D 1/108 222/214
2007/0106422 A1 * 5/2007 Jennings ..... B25J 9/0084 700/245
2008/0023488 A1 * 1/2008 Guerrero ..... B67D 1/0001 222/129.4
2009/0008407 A1 * 1/2009 Sevcik ..... B67D 1/0021 222/1
2009/0069933 A1 * 3/2009 Rudick ..... B67D 1/0034 700/239
2009/0069934 A1 * 3/2009 Newman ..... B67D 1/0021 700/239
2009/0069947 A1 * 3/2009 Newman ..... B67D 1/0021 700/281
2009/0159608 A1 * 6/2009 Shoenfeld ..... G06F 19/3462 221/1
2010/0072273 A1 * 3/2010 Brown ..... B67D 7/02 235/375
2011/0017776 A1 * 1/2011 Metropulos ..... B67D 1/0888 222/129.1
2011/0139166 A1 6/2011 Luzenberg, Jr.
2011/0172813 A1 * 7/2011 Baric ..... G07F 11/10 700/232
2014/0263430 A1 * 9/2014 Keating ..... B67D 3/0051 222/54
2014/0284349 A1 * 9/2014 Metropulos ..... B67D 1/0888 222/23
2014/0299630 A1 * 10/2014 Brown ..... B67D 1/06 222/129.1
2015/0102062 A1 * 4/2015 Mosimann ..... B67D 1/0022 222/129.1
2015/0336689 A1 * 11/2015 Brown ..... B65B 3/12 141/98

* cited by examiner

SYSTEM FOR DISPENSING CUSTOM BLENDED ELECTRONIC CIGARETTE LIQUID

CROSS REFERENCE TO RELATED APPLICATION

The present application is based on and claims the benefit of U.S. provisional patent application Ser. No. 61/892,020, filed Oct. 17, 2013, the content of which is hereby incorporated by reference in its entirety.

BACKGROUND OF THE INVENTION

Electronic cigarettes are electronic devices used as inhalers to simulate and/or substitute traditional methods of smoking tobacco (i.e. rolled/paper cigarettes, pipes). Electronic cigarettes are generally filled with a small amount of liquid, which when heated is vaporized and inhaled by an operator of the electronic cigarette. Presently, the liquid, which is generally a mixture of propylene glycol, vegetable glycerin and/or polyethylene glycol 400 is premixed in mass amounts with various flavorings as well as nicotine in amounts similar to that of paper cigarettes. The liquid is generally packaged for shipping and sale and is sold to consumers in bottles and/or pre-filled cartridges. While liquids of various flavors and standard nicotine levels are available, the selection is limited as the liquids are mixed in large batches and are then bottled or loaded into cartridges for sale.

Presently, electronic cigarettes and the liquid for use therein are thought of as smoking substitutes, or safer cigarettes due to the elimination of burning added chemicals and components generally present in paper cigarettes. However, these liquids still generally contain addictive levels of nicotine. Further, these liquids may be flavored for sale, however the flavors are of a standard strength and limited variety. Presently, it is not cost effective or efficient to custom blend liquids including not only custom flavors, but also custom flavors and nicotine levels. Since the liquid is prepared in batches and then divided into smaller portions for retail sale, it is nearly impossible for a user to tailor not only the nicotine level, but also the flavor. No product available allows a user to potentially reduce (or increase) the amount of nicotine in the liquid in small increments, or to reduce the amount of nicotine in the liquid to absolutely zero.

The flavor offerings for these liquids are also limited to popular selling flavors like single fruits or menthol. Moreover, because it is not cost effective to mix flavors in small batches, manufacturers only mix popular flavors, which are sure to be bought by consumers. Combination flavors do not generally extend beyond common combinations, and as such, the flavor options for a user of electronic cigarettes are also severely limited.

SUMMARY OF THE INVENTION

An aspect of the present disclosure relates to a system for accurately dispensing small amounts of a custom blended liquid for vaporizing in an electronic cigarette device. The system comprises a housing having a liquid dispenser contained therein; a processor configured for receiving, translating and transmitting at least one data input; and a first interactive display device for receiving at least one user input and transmitting the at least one user input to the processor. The system further comprises a second and third interactive display configured for receiving a translated data input from the processor. The liquid dispenser is in electronic communication with the second interactive device and the processor and comprises at least one container for holding a liquid component; at least one dispensing spout for dispensing the at least one liquid component as a mixture; and at least one pump for moving the at least one liquid component from the at least one container to the at least one spout. The system further comprises a plurality of calibrated delivery devices, the devices for dispensing a liquid flavoring to the dispensed mixture.

Another aspect of the present disclosure relates to an automatic dispenser for accurately dispensing small amounts of components wherein cross-contamination is eliminated. The dispenser comprises a housing, a first and a second reservoir for holding a first and second component respectively and a third and a fourth reservoir for holding a third and fourth component respectively. A plurality of containers are configured such that each container holds a component. The system further comprises a plurality of pumps, only one pump being connected to each container and reservoir, and at least three distinct spouts wherein a first and a second spout are each connected to the first and second reservoirs and a container. Each spout is connected by separate tubing and a third spout is only connected by separate tubing to a plurality of containers. An interactive display for displaying the components to be dispensed and the reservoirs, containers and pumps are disposed at least partially within the housing, and the interactive display and the spouts are disposed on the housing.

DETAILED DESCRIPTION

Figure 1:
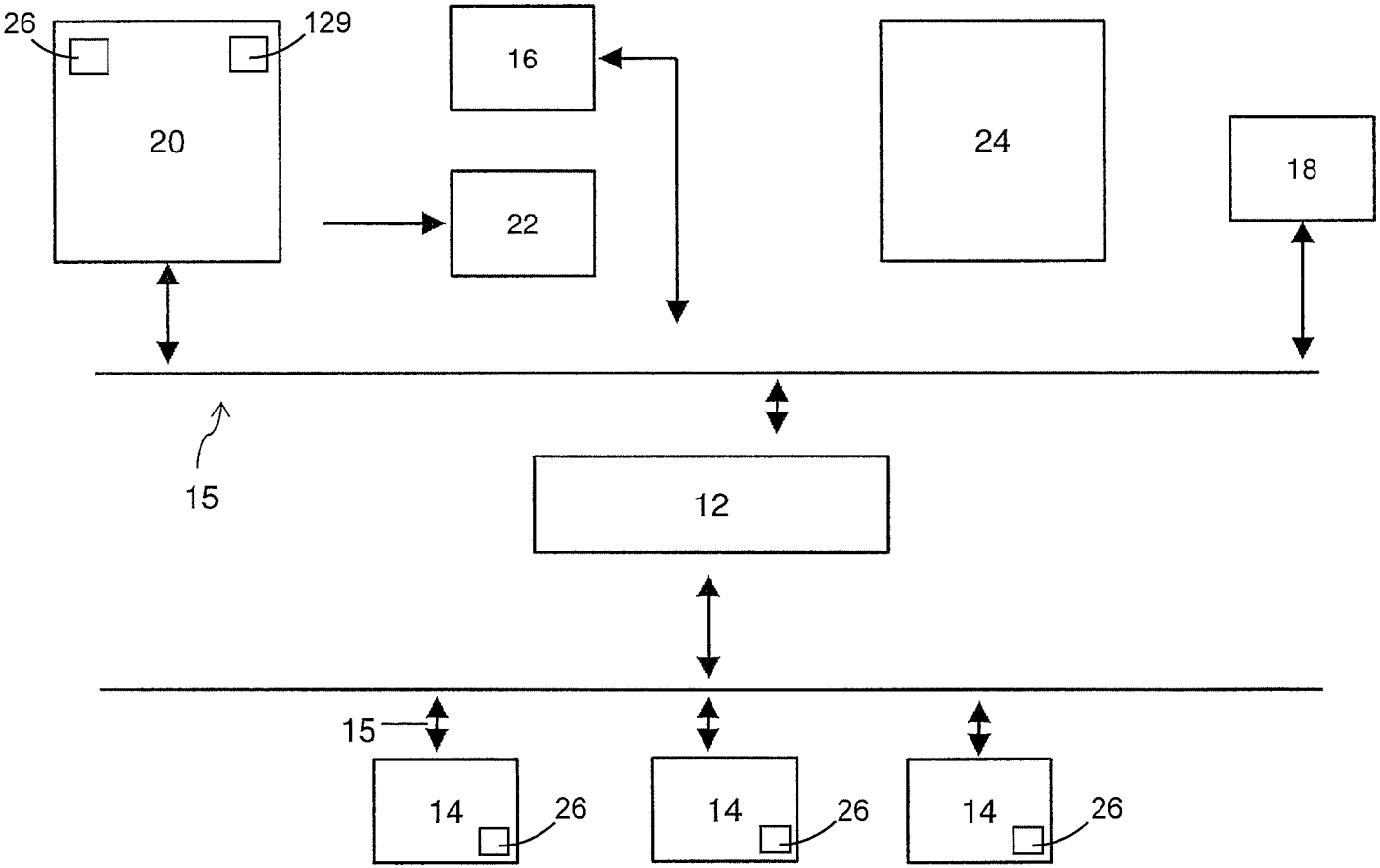
FIG. 1 is a flow diagram of a custom blended liquid dispending system of the present disclosure.
Figure 2:
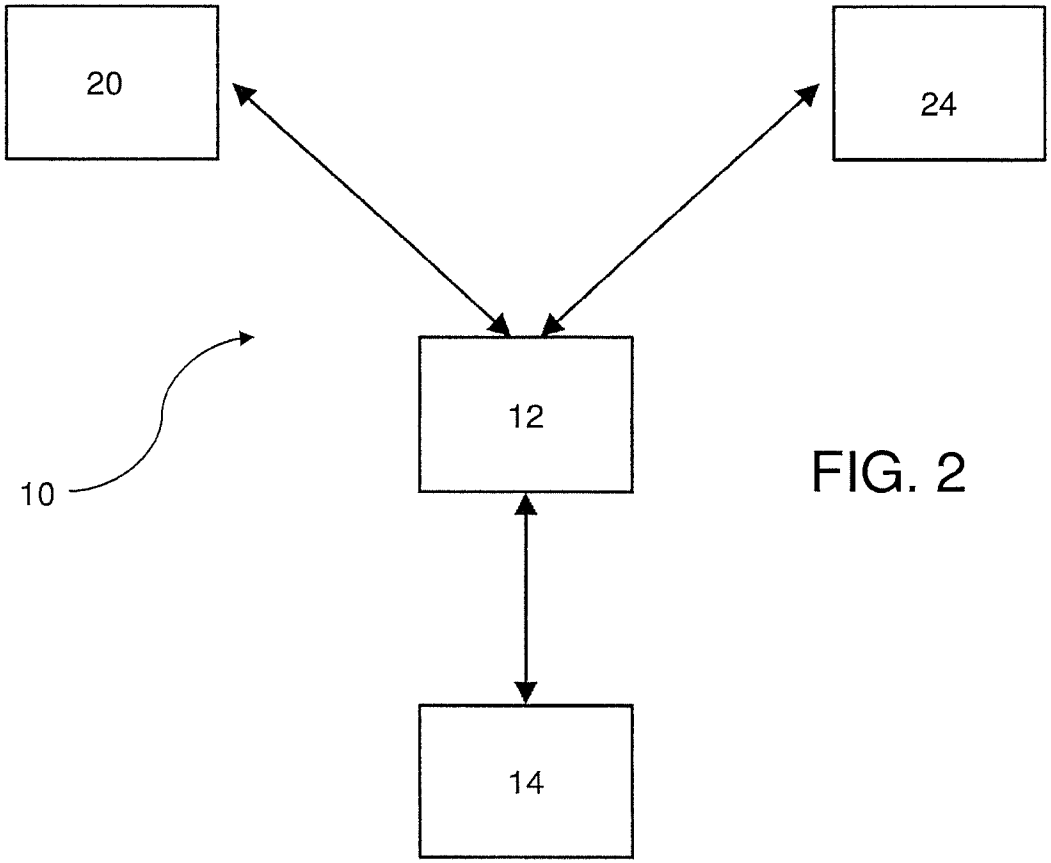
FIG. 2 is a flow diagram of the dispensing system.
Figure 3:
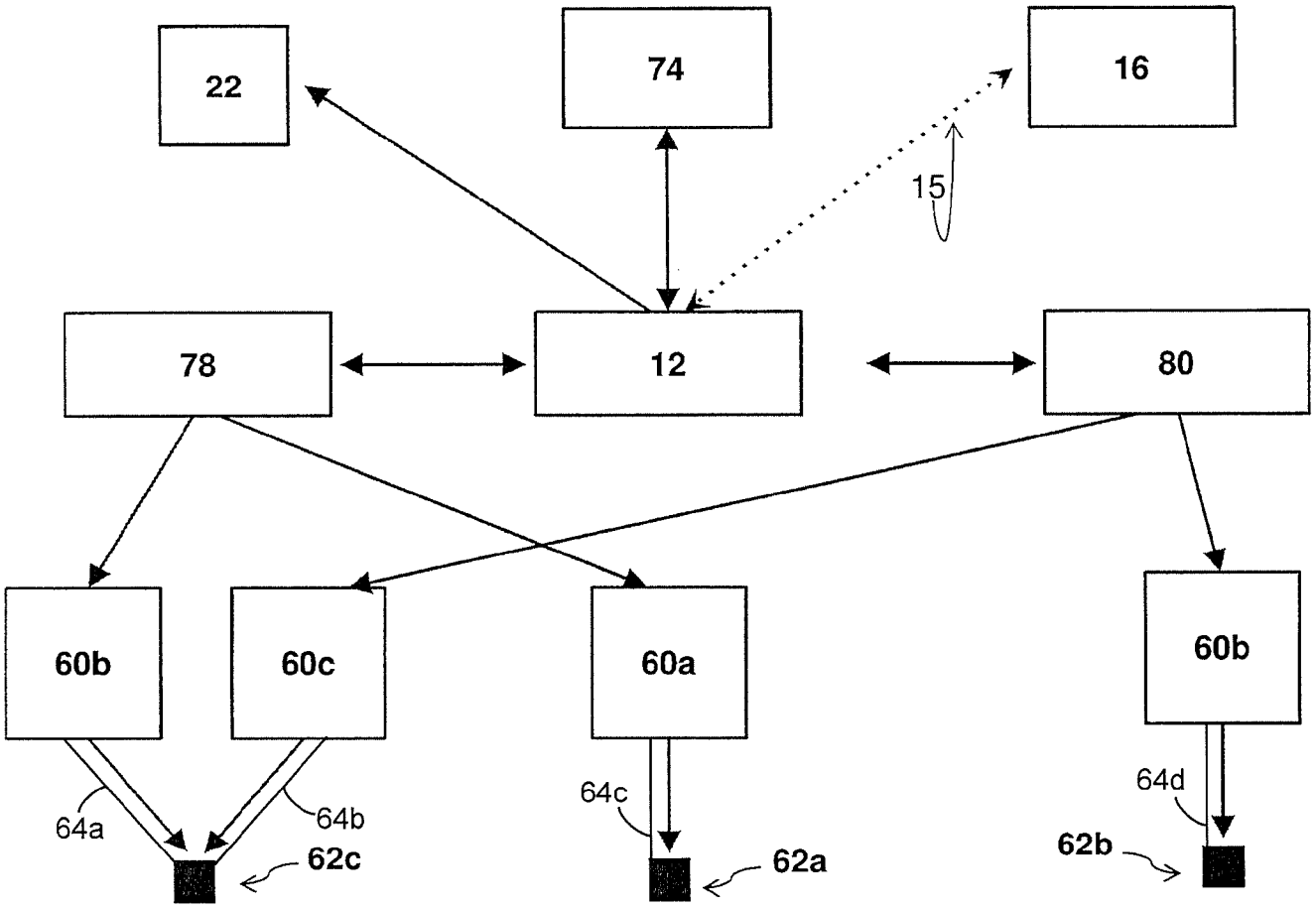
FIG. 3 is a flow diagram of a communication system of an ordering, blending and dispensing component of the system.

Illustrated generally in FIGS. 1-3 is a system for dispensing a custom blended liquid in pre-determined small amounts. The custom blended liquid may be used with various types of electronic cigarettes or other vaporization devices. The system 10 has a controller 12 connected to a first interactive display 14 by a wireless connection 15. The controller 12 is also connected to both a second interactive display 16 and a third interactive display 18. The controller 12 is connected to the second display 14 and third display 16 by a wireless connection for communication. The system 10 also has a dispensing module 20 and a label printer 22, as well as a flavor module 24. A software system 26 controls the first interactive display 14 and liquid dispensing module 20 while facilitating communication between each of the interactive displays 14, 16, and 18 and the controller 12. The system 10 may be designed to operate in a retail sales environment and the system 10 is able to dispense an individual bottle 28 of a custom blended liquid 30 in only a matter of seconds.

Figure 4:
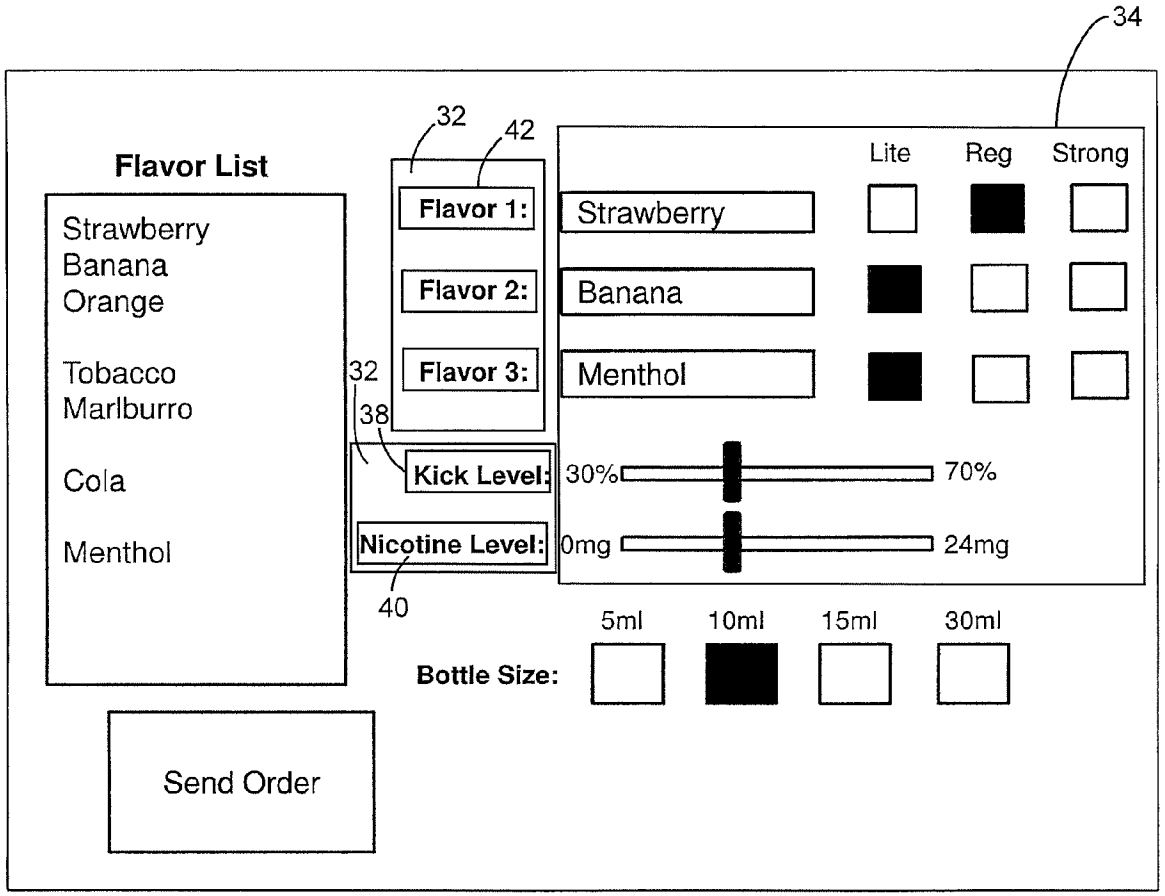
FIG. 4 is a front view of a first interactive display of the system.

As illustrated generally in FIG. 4, the first interactive display 14 is a point of sale input screen. The first interactive display 14 may also refer throughout this disclosure as the "point of sale" display, meaning the first interactive display 14 is programmed to receive parameters 32 from a customer for a selected custom blended liquid 30 order. The parameters 32 include the individual components and their respective amounts for comprising the custom blended liquid 30. The parameters 32 are selected by a user and are input into the point of sale display 14 by an operator, allowing selected components to be communicated to the controller 12. As used throughout this disclosure, the term "user" or "customer" refer to the user of the blended liquid 30 and the term "operator" refers to the operator of the system 10.

The software within the controller 12 translates the parameters from the point of sale display 14 into instructions that may be in the form of a specific formula 34 described according to the amounts of each component required. The controller 12 communicates the instructions and thus formula 34 to the second display 16 and the third display 18. The point of sale display 14 may be an independent and separate physical display unit that is wirelessly connected to, and thus wirelessly transmits the formula 34 of the custom blended liquid 30, to the dispensing module 20 and flavor station 24 via the controller 12. The point of sale display 14 may be positioned away from the dispensing station 20, the controller 12 and/or the second display 16 and third display 18. For example, the point of sale display 14 may be used at a kiosk or counter at which custom blended liquids 30 are ordered while the components are mixed and automatically dispensed in an adjacent room or another area.

Each custom blended liquid 30 comprises a base mixture, which may be a mixture of propylene glycol ("PG"), vegetable glycerin ("VG"), PG/30 mg nicotine blend ("PG30") and VG/30 mg nicotine blend ("VG30"). The base mixture is custom blended allowing a user to select a kick level 38. The kick level 38 is the ratio of PG to VG in the base mixture. The user may select a ratio of PG to VG based on their preferences. For example, a smaller ratio of PG to VG may result in a vapor that is considered smoother when inhaled. The amount of PG in the base mixture can range from 0% to 100% by weight of the total base mixture. The user then selects the total amount of the custom blended liquid 30 to order. The system 10 may then be configured to dispense custom blended liquids accurately in amounts as small as 5 mL, 10 mL, 15 mL and/or 30 mL.

The user then also selects a nicotine level 40, ranging from zero grams to approximately 24 grams. This nicotine level 40 is achieved by blending PG, VG, PG30 and VG30. The exact mixture is calculated to ensure that the PG:VG ratio is maintained while producing the desired nicotine level 40. The system 10 also allows the user to select a blend of individual components to produce the custom blended liquid 30 for use in an electronic cigarette wherein the liquid contains absolutely no trace of, nicotine. When a nicotine level of zero is selected, the PG and VG components are dispensed through a separate spout, such that the chance of cross-contamination with nicotine is eliminated.

To further customize the blended liquid 30, the user may also select a flavor 42 including a blend of flavors. The user can blend, for example, up to three different flavors 42 in any combination and select varying strengths of each flavor allowing the user to essentially create a completely custom flavor. A strength level of each flavor may be selected, for example, the flavoring can be light, regular, or extra strong. In addition to the strength levels, the system allows the user to further customize the blended liquid 30 by setting the flavor strength in terms of a percentage ranging approximately from 1% to approximately 30%. The system 10 may be calibrated such that selecting the 'regular' flavor level for a selected flavor will as a parameter will result in a formula including a percentage corresponding to a pre-programmed 'regular' percentage. Selecting the 'light' and 'extra' parameters on the point of sale display 14 adjusts the percentage by a factor from the 'regular' setting. This factor may be approximately 0.5 for light parameters and approximately 1.5 for extra parameters. The flavors a user may select are essentially unlimited and would only be limited by the flavor components on hand or as available to purchase. For example, flavors may include traditional menthol flavors as well as various fruit and other flavorings.

Each component of the custom blend 30 is manually input into the point of sale display 14. The point of sale display 14 is configured to communicate the inputs and their respective amounts or strengths, as well as a selected total amount for the custom blended liquid 30 to the controller 12. The controller 12 utilizes an algorithm to compute an exact amount of each component to dispense, the amount based on the total amount of the custom blend ordered, the desired components, and their respective levels or strengths. The controller 12 then transmits the resultant formula 34 to a dispenser controller 12*a* for mixing and dispensing the components in the dispensing module 20.

The controller 12 having a computer controlled software system is configured for receiving, translating and transmitting input from the point of sale display 14 to the second display 16 and third display 18. For example, the software system may be purchased as an RTI backbone from Remote Technology Inc. The main controller may be an RTI XP-6 and each relay controller may be an RTI XP-8. Handheld tablets or other similar mobile devices including an iPad or Android are suitable for running the RTiPanel or iOS application. The RTI processors and RTiPanel application provide an operating environment where custom applications can be developed and deployed. The RTI processor contains a Javascript engine that allows developers to write a custom application, in Javascript that runs on the RTI processors. All order processing, machine calibration, testing, and flavor calculations may be performed within this custom Javascript code.

Each interactive display 14, 16, and 18 being an interface comprising a computer monitor, tablet or mobile display device may also be customized using the RTiPanel application as the software also supports communication between the controller and each interface by the Javascript running on the processors. Moreover, the software also includes a fully customizable application software that can be used to program the flavor list and settings into the flavor station. Alternatively, the system can be run using a custom process and custom application for various tablet types.

Figure 5:
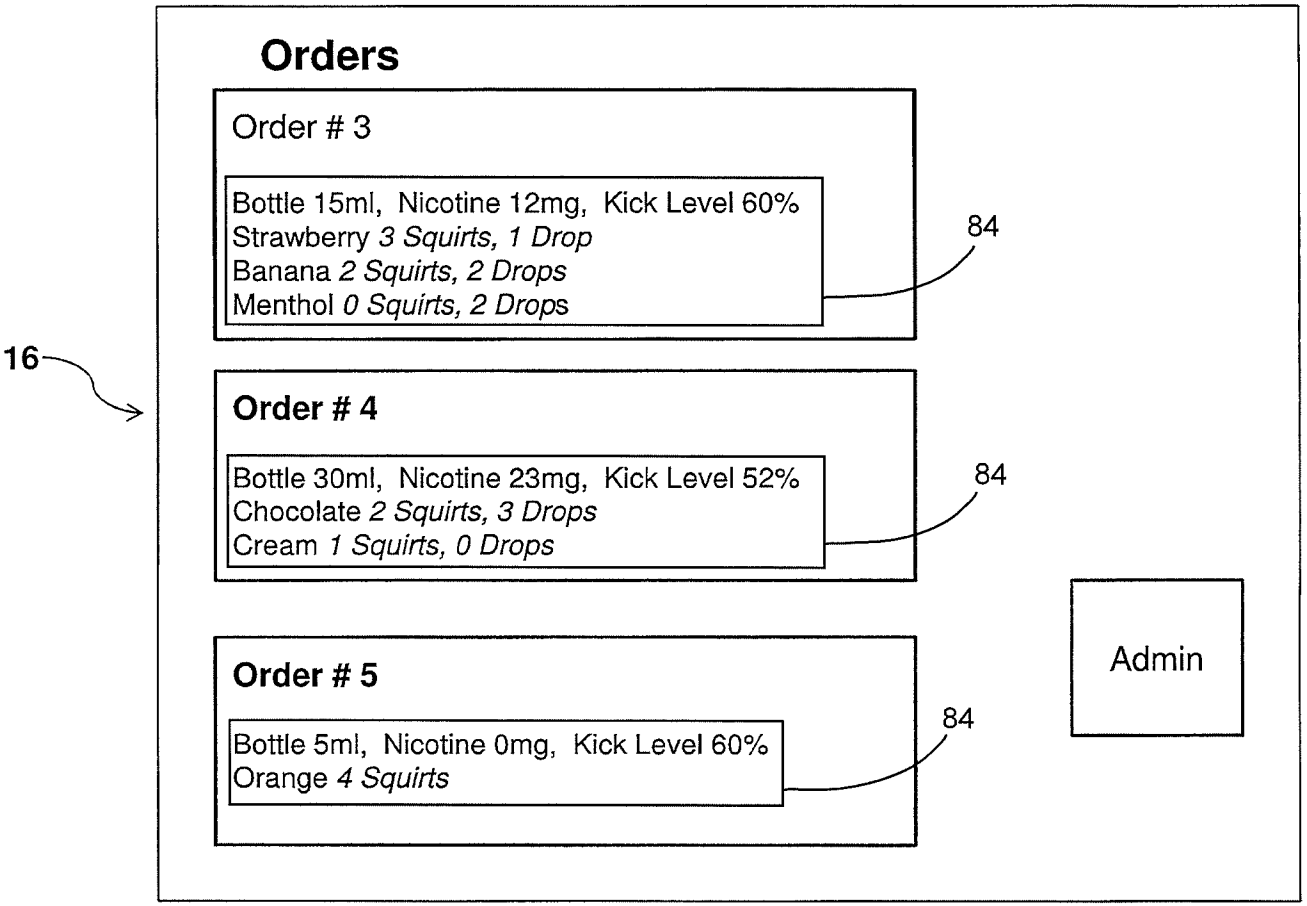
FIG. 5 is a front of a second interactive display of the system.
Figure 6:
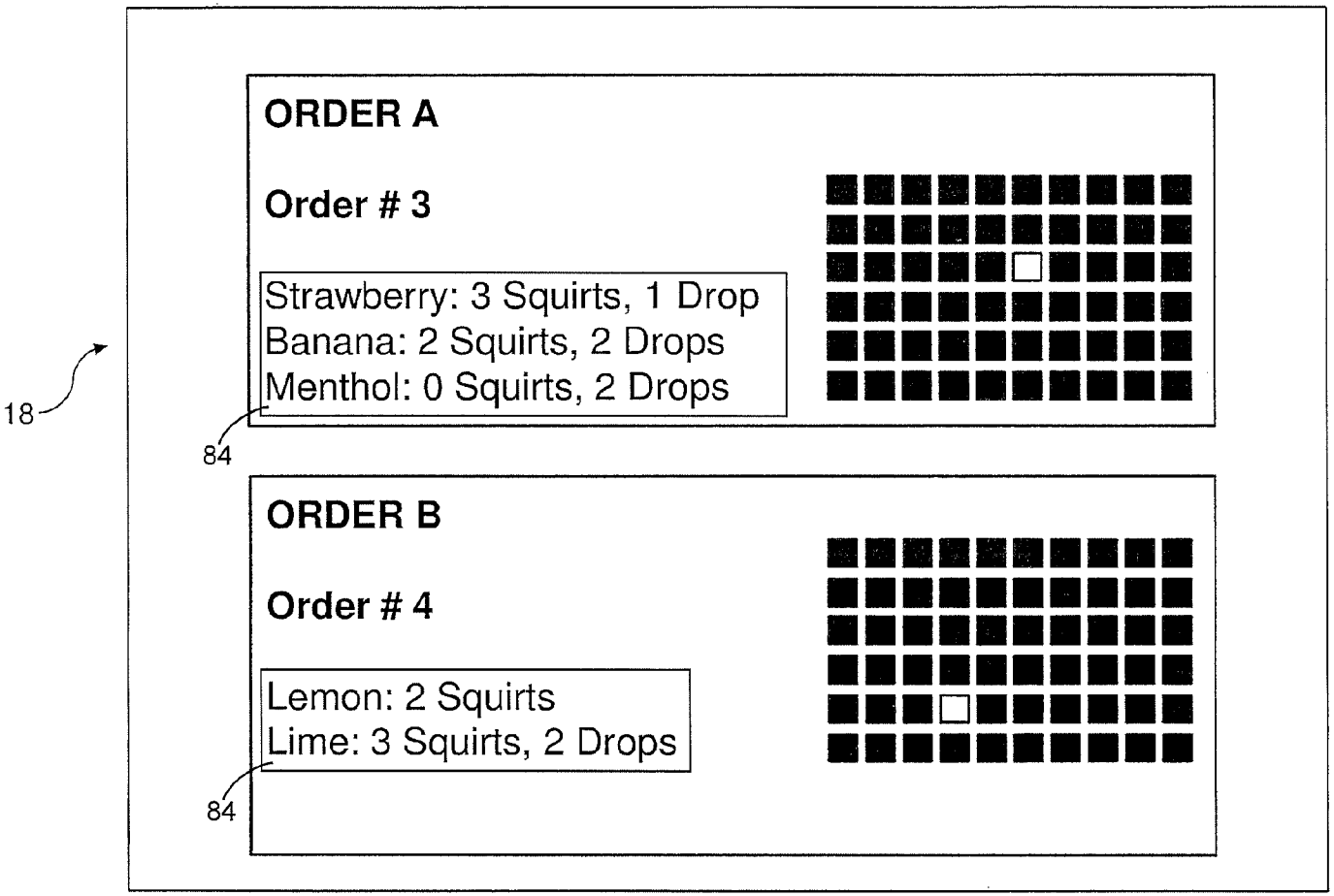
FIG. 6 is a front view of a third interactive display of the system.
Figure 7:
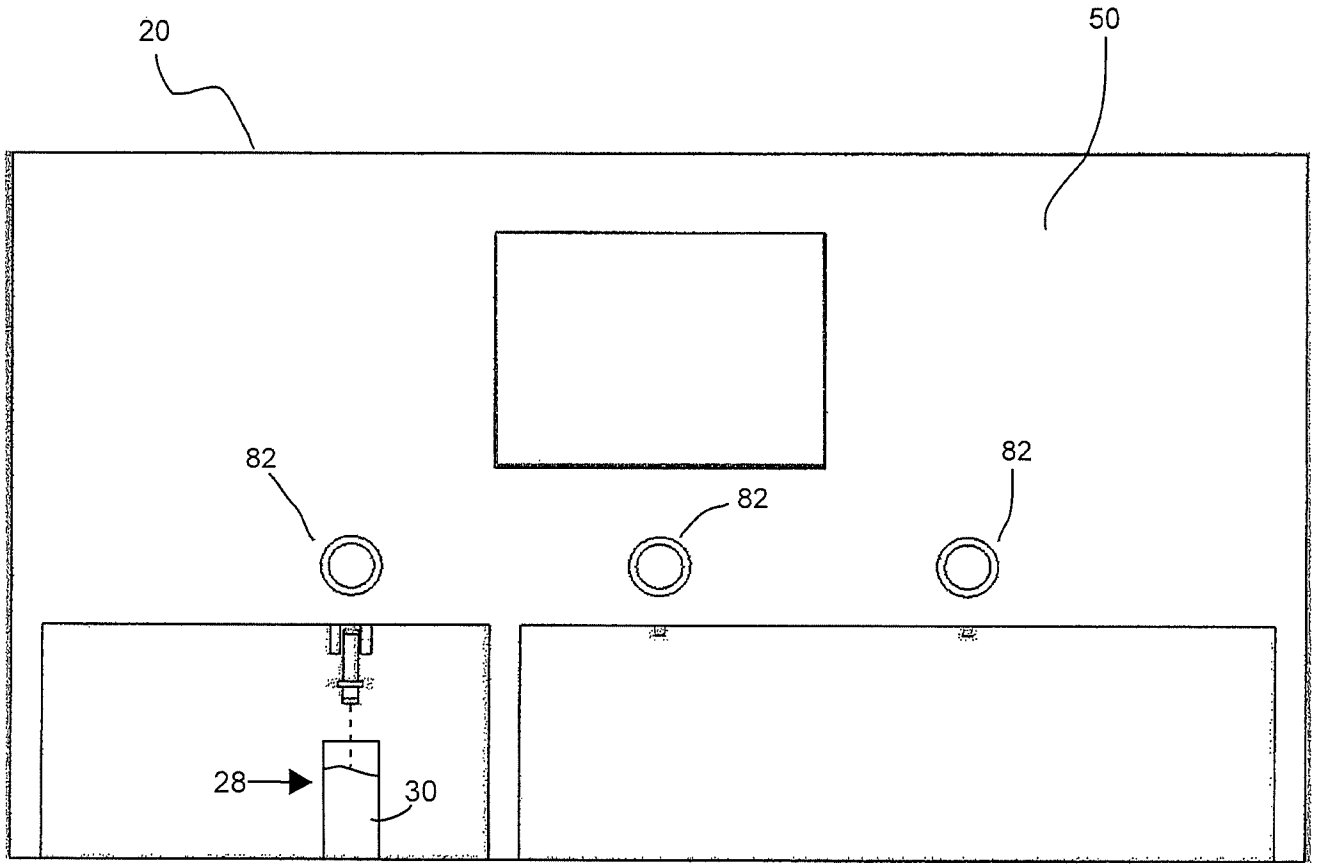
FIG. 7 is a front view of a dispensing module of the system.
Figure 8:
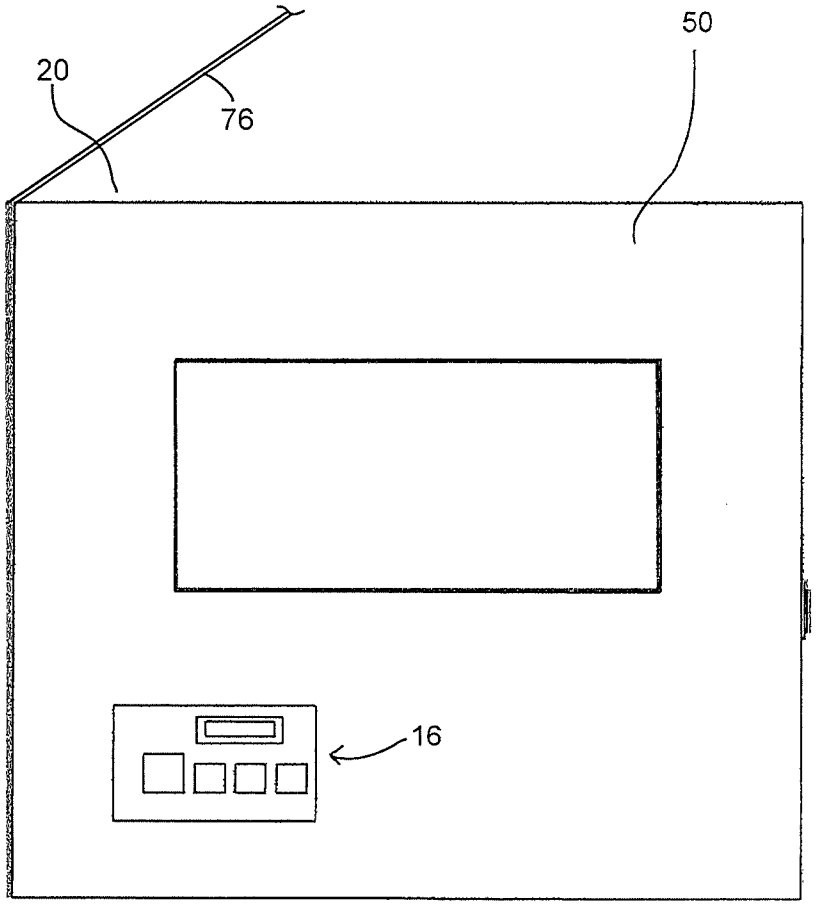
FIG. 8 is a side view of the dispensing module of the system.
Figure 9:
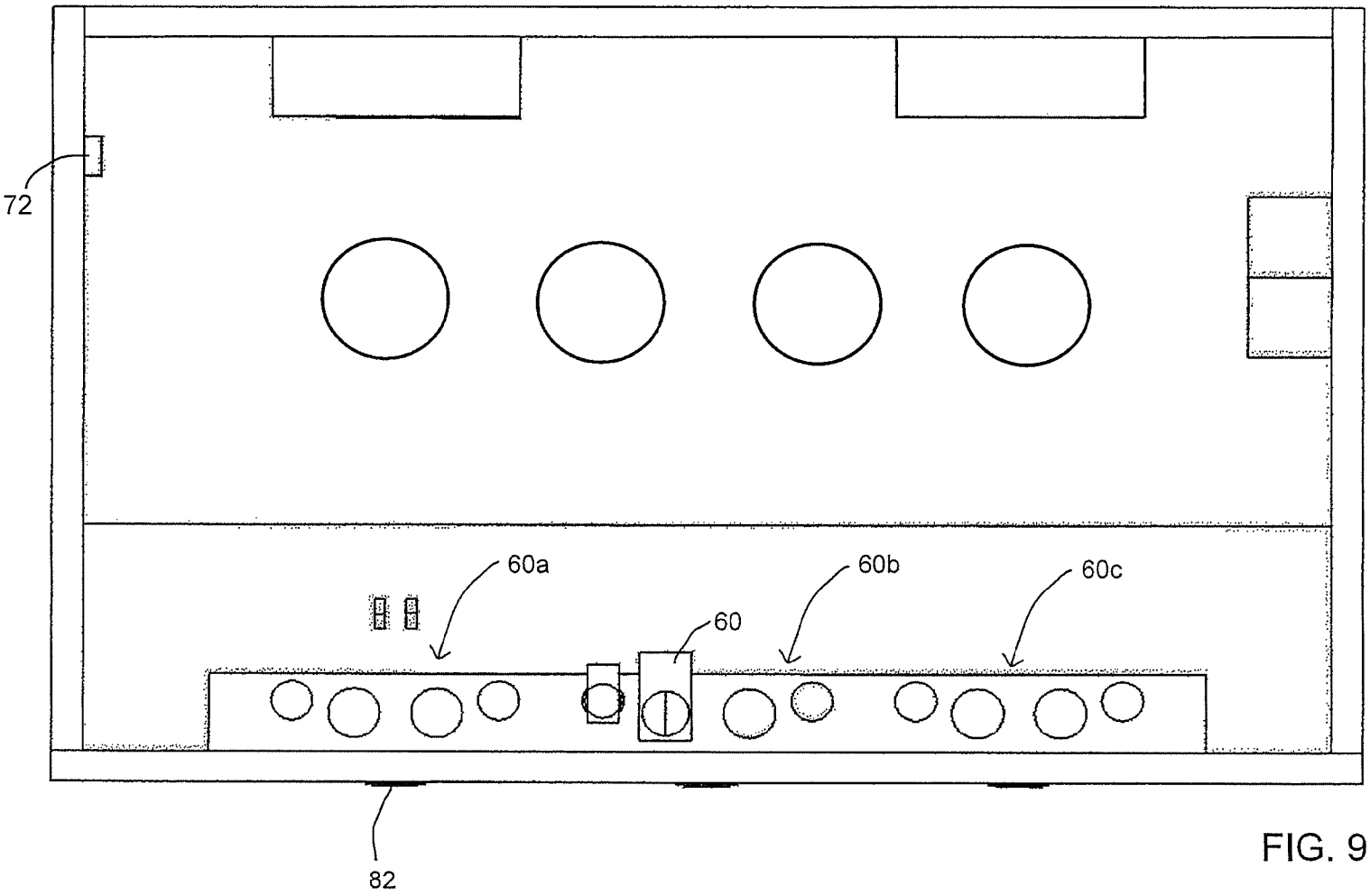
FIG. 9 is a top view of the open dispensing module of the system.
Figure 10:
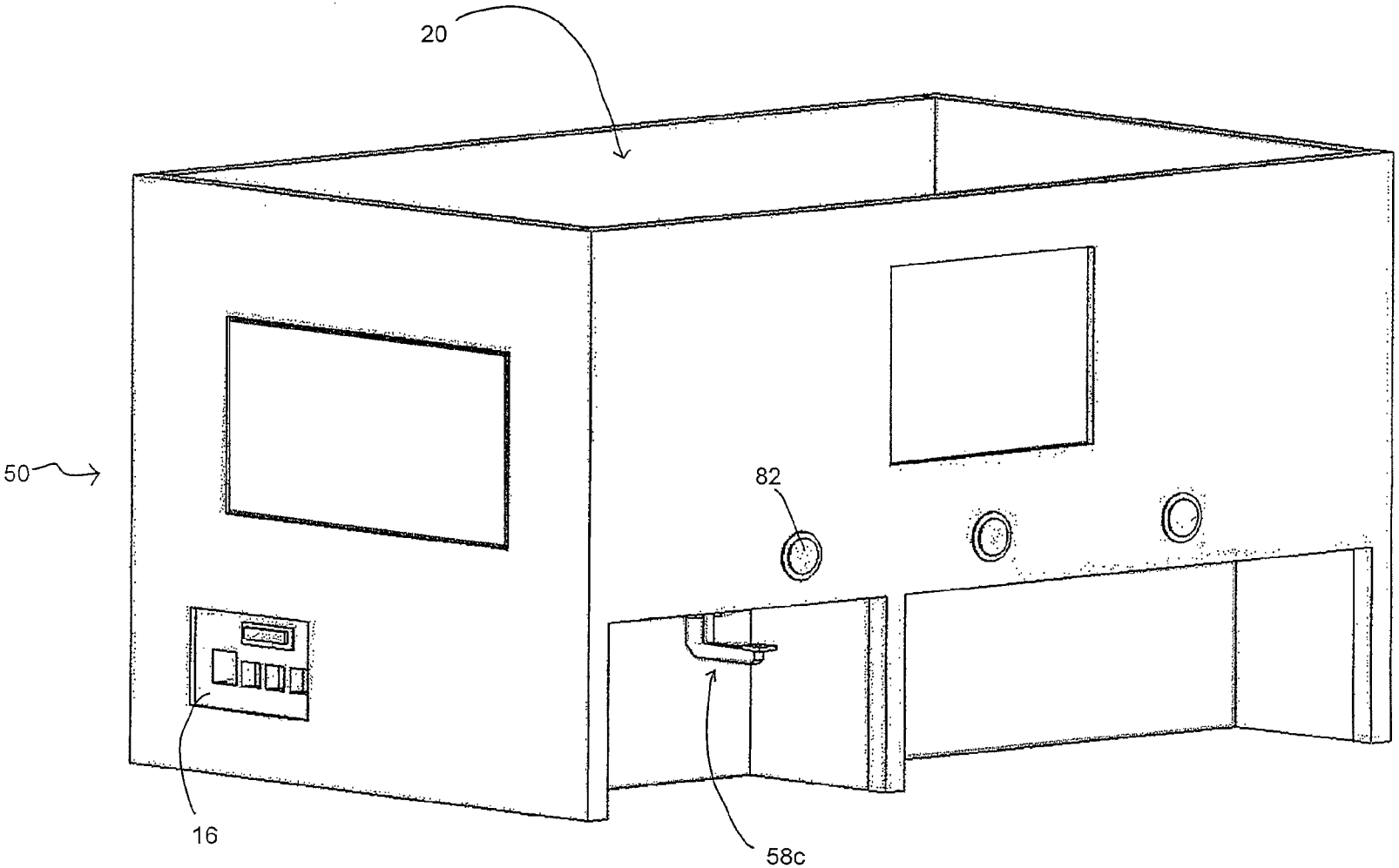
FIG. 10 is a front perspective view of the dispensing module of the system.

From the controller 12, the point of sale display 14 inputs related to nicotine level, kick level, total liquid amount and thus bottle size are transmitted to a dispenser controller. As illustrated in FIGS. 4 and 5, an operator will select the inputs for the components on the point of sale display 14 and a formula as translated and transmitted will be displayed on the second interactive display 16. The second interactive display 16 is a dispenser display 16, which may be connected either wirelessly, or by wired connection, to the dispenser module 20. The dispenser display 16 is generally in close proximity to the dispenser module 20 itself, and as illustrated in FIG. 7 is an integral component on a front face of the dispenser module 20. The dispenser controller and the dispenser display 16 cooperate to display the pending blended liquid 30 orders to be mixed and dispensed. They also cooperate to control and allow for calibration and testing of electrical and computerized components of the dispenser module 20, to ensure exact measurement and dispensing of each component.

When dispensing a custom blended liquid 30, the operator selects from the second interactive display 16 which liquid 30 order the dispenser module 20 will mix and dispense. Multiple pending blended liquid orders may be displayed for mixing and dispensing at a given time. As the dispensing display 16 indicates the selected amount and thus bottle size required, the operator retrieves and positions the appropriate size bottle 28 for dispensing into. Once the selected bottle 28 is positioned under a spout on the dispenser module 20, the operator will then initiate dispensing by activating the dispenser module itself. Moreover, a selected spout for dispensing will be indicated on the module by an indicator light that may blink to indicate imminent dispensing.

The dispenser controller includes computer-controlled software in which accurate amounts of each component of the selected blended liquid 30 are automatically dispensed into the bottle 28 from the dispenser module 20. The main controller 12 for the system 10, a processor, is housed within the dispensing module 20. This processor, an RTI XP-6, contains all order processing and machine administration functions (UI processing, etc.). Relay controllers receive commands from the main controller 12 to perform specific pumping and dispensing tasks. For example, during calibration, the main controller 12 commands a relay controller to dispense using a certain pump for a specific amount of time. During normal operations, the main controller 12 instructs the relay controller to dispense a selected amount. The relay controller then uses its calibration settings to perform the task. The dispenser controller also controls the label printer 22, which prints a custom label with the formula 34 indicating the flavor, nicotine level and kick level, and amount of the custom blend, allowing the operator to apply the label and seal the bottle once the blended liquid 30 has been dispensed therein. The dispensing module 20 dispenses the selected custom base mixture including the addition of any nicotine. Flavor components are later dispensed into the base mixture at the flavor module 24 as will be discussed further below.

As illustrated in FIGS. 9-12, the dispenser module 20 is a housing 50 where all dispensing mechanics may be contained therein. The housing 50 is of a size sufficient to store all components described hereinafter. In the embodiment illustrated, the housing 50 may be approximately 30 inches wide and approximately 18 inches deep. Reservoirs 52, 54, 56 and 58 are positioned along a bottom of the housing 50. The reservoirs 52, 54, 56 and 58 each hold a supply of either the PG, VG, PG30 or VG30 component. When the base mixture and nicotine level are selected, product is dispensed from the corresponding reservoir 52, 54, 56 and 58. In the event a blend is selected with a nicotine level of zero, the PG and VG are dispensed from separate reservoirs storing PG and VG. This arrangement further eliminates unwanted or unintended dispensing of nicotine in a blended liquid 30. Each reservoir may be of a size sufficient to hold approximately one (1) liter of each component.

Figure 11:
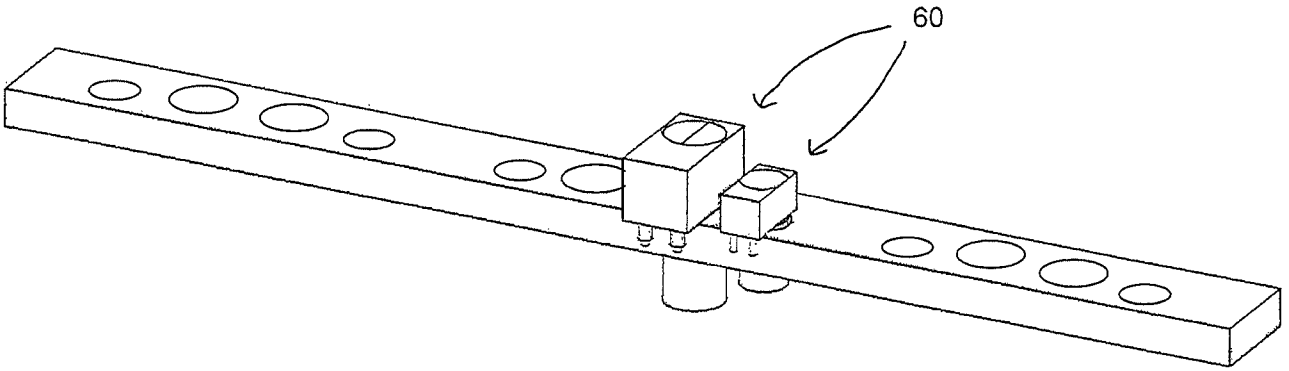
FIG. 11 is an exploded view of a pump of the present invention.
Figure 12:
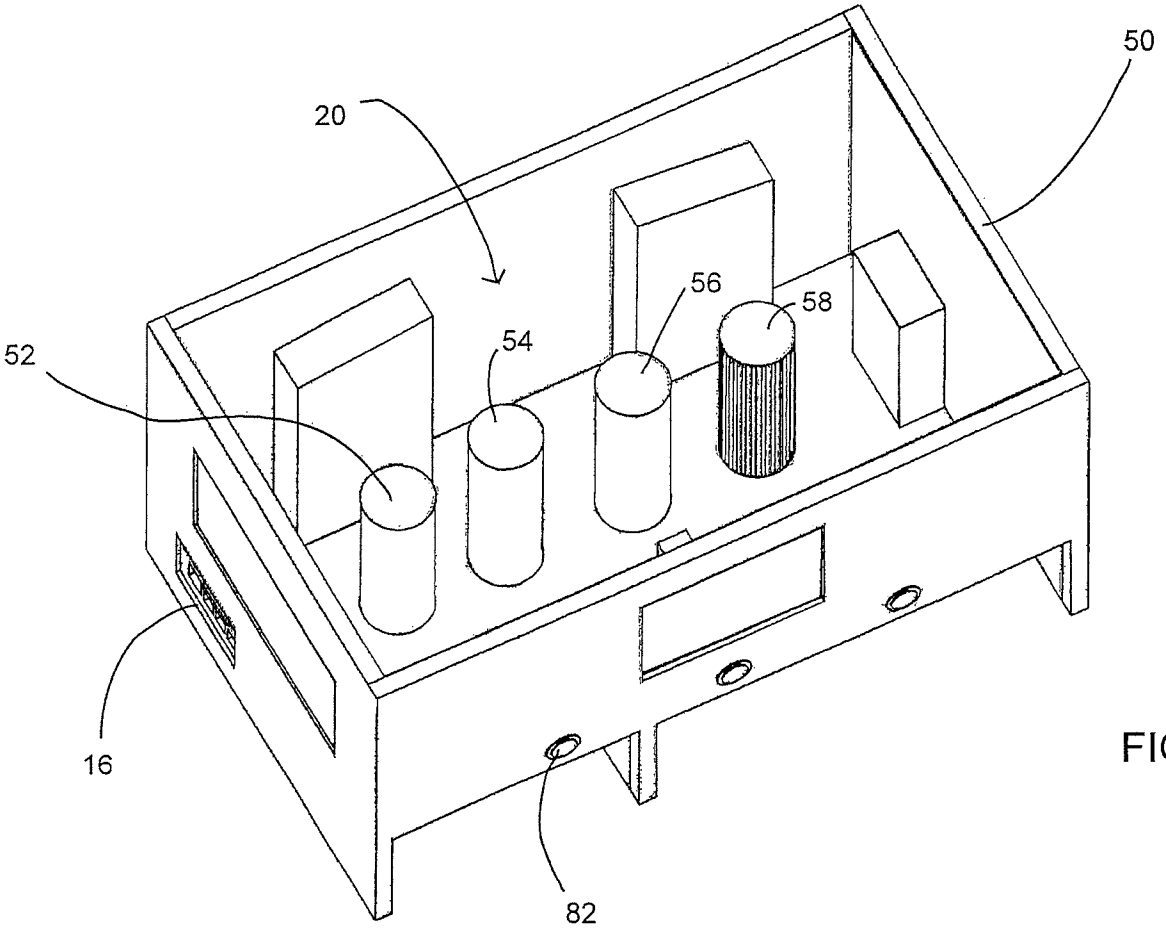
FIG. 12 is a top perspective view of the open dispensing module of the system.

In further detail, as illustrated in FIGS. 11 and 12, the dispenser module 20 has twelve pumps 60 contained within the housing 50 and three stainless steel dispensing spouts 62 located externally on a front face of the housing 50. The pumps 60 are disposed within the housing 50, with the pumps positioned on a first and second side of the housing 50 allowing the housing 50 to hold dual and redundant dispensing systems. Referring back to FIG. 3, a first set of four pumps 60*a* and two additional no-nicotine pumps 60*b* form system A. A second set of four pumps 60*b* and two more additional no-nicotine pumps 60*c* form system B. A first dispensing spout 62*a* is dedicated to system A and a second spout 62*b* is dedicated to system B. Third spout 62*c* is dedicated to dispensing only blends where nicotine levels are zero, and the third spout is thus operational with both systems A and B. The dispensing systems A and B combine to form a dispensing module 20 that is fully redundant. If one pump 60 fails or a full system A or B fails, the remaining system A or B may function as a backup system, remaining operational.

Of the pumps 60 in each system A and B, there is a pump 60 for dispensing each combination of PG, VG, PG30, and VG30. In the embodiment illustrated, two sizes of pumps may be used, a small knf 11 pump, running at 500 milliamps of 24 volt DC power and a larger knf 30 pump running at 800 milliamps of 12 volt DC power. The larger pumps may be required for the VG product. The smaller pumps are then required for dispensing the PG product. Each pump 60 is designed to pump the corresponding liquid component from its reservoir 52, 54, 56, 58 to a specific dispensing spout. To accomplish this, four separate copper tubes 64*a*, 64*b*, 64*c*, and 64*d* extend into connection with a dispensing spout, the spouts all being positioned externally on the front of the housing 50. Each tube 64*a*, 64*b*, 64*c*, and 64*d* represents a component from one of the four reservoirs. With the exception of the first spout, the non-nicotine spout, which delivers PG/VG A & PG/VG B via tubing, the second and third spouts (i.e. nicotine A and B) contain PG, VG, PG30 and VG30 tubes. The separate tubes 64*a*, 64*b*, 64*c*, and 64*d* further eliminate any possibility of the dispensing of a previous mixture having an effect on concentrations and components of a subsequent order. The three dispensing spouts are each connected by tubing, which may be flexible and/or clear tubing, to each corresponding set of four pumps. Each spout also has a feed line running to a PG, VG, PG30 or VG30 reservoir.

On a first side of the housing 50 is an air intake fan allowing airflow to cool the module 20 and maintain temperature control in the module 20. A second fan is located on the top of the housing 50 for exhaust. On an opposing side of the housing 50 is an input jack 72 which allows a scale to be connected for measuring and for calibrating the dispenser and its components. The input jack 72 also connects to the label printer 22 and supports a wired network connection. The input jack 72 also supports connection of the dispenser module 20 to a power supply and has an on/off switch for manual control of the module's power supply.

The housing 50 also has a lid 76, which provides easy access to the pumps 60, other electronic components and all other equipment stored therein for maintenance as well as access for refilling liquid storage containers and reservoirs.

The lid 76 is hinged to the top of the housing 50 and securely latches the lid 76 in a closed position. The latches may be lockable to prevent unwanted or unauthorized access to internal components of the housing. The internal components of the dispensing module 20 also include main processor and controller communication equipment for communication with the point of sale display 14. Two relay controllers 78 and 80 are also used for receiving commands and formulas from the main processor. One relay controller is positioned on the first side of the housing and controls system A including the pumps. A second relay controller is positioned on an opposing side to control the system B pumps. A thermostat and a temperature sensor are positioned in a back area of the housing. The temperature sensor sends a signal remotely, indicating temperature information at any given time. The signal is sent to an external receiver for constant monitoring. It is critical that the inside of the dispenser module 20 housing 50 maintains the temperature at which the machine was calibrated so that component dispensing remains accurate. The thermostat also controls intake and exhaust fan operation to maintain a constant temperature in the housing, for example, a temperature of approximately 76° F. may be maintained. Temperature control is also critical in order to provide consistent flow rates of each component to be dispensed.

Once the operator has selected the blend to be dispensed and the dispenser is ready, a spout indicator light 82 will illuminate to notify the operator which spout the liquid will be dispensed from. The operator simply positions the bottle over the stainless-steel spout, indicated by an illuminated light, and the dispenser will dispense the base mixture and nicotine therein. Once completed, the light will cease and the operator simply removes the bottle and caps it. The operator may also indicate by interacting with the dispenser display that a label is to be printed bearing the details of the custom blend. The label will print automatically from the label printer 22 on the side of the housing 50 and the operator may then apply it to the bottle.

For each custom blend, the point of sale display 14 communicates to the controller 12 the complete formula for dispensing, including flavor. As discussed previously in this disclosure, the controller 12 communicates the base mixture formula and nicotine level, or dispensing components, to the dispenser controller. The controller also similarly communicates the flavor components and strengths selected to the flavor module. The controller again uses an algorithm to convert the flavor input and respective strengths into a flavoring formula easily and accurately dispensable by the operator. The flavor module comprises the third interactive display and a flavor module.

The third interactive display 18 is a flavor module display which displays each custom blend order and a corresponding flavor formula. This allows the operator to verify that the base mixture dispensed into the bottle corresponds to the flavor selection to complete the custom blended liquid 30 order. The dispenser display 16 and the flavor display 18 will display each custom blend order placed allowing the operator to verify the flavor formula when multiple custom blended liquids 30 are in queue for flavoring. The controller 12 provides to the flavor display 18 a flavor mixing formula 84 for the operator. The formula 84 is represented as an amount of each flavor component to be added to the blended liquid 30, the amount displayed as a combination of "squirts" and/or "drops". The operator will then use the information from the flavor display 18 to accurately dispense flavor into the bottle in which the base liquid mixture has previously been dispensed.

Figure 13:
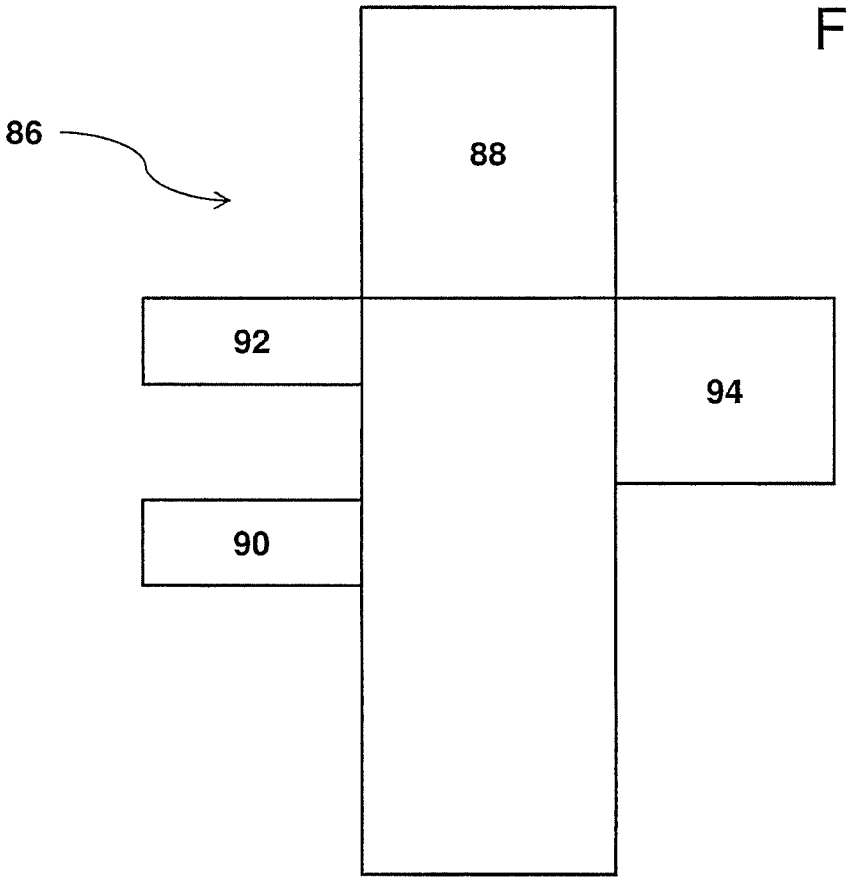
FIG. 13 is a schematic view of a flavor gun of the system.

As illustrated in FIG. 13, the flavor module allows the operator to accurately dispense the selected flavors and amounts. The flavor module has a plurality of individual, calibrated pumping guns 86. Each pumping gun 86 is dedicated to one liquid flavor and each pumping gun 86 stores up to approximately 60 ml of a respective flavor in a reservoir compartment 88. Each gun is precisely calibrated, similarly to a calibrated pipette, however each gun is calibrated to deliver a single drop, up to ten drops upon squeezing a trigger 90, and to deliver a squirt upon a full, quick trigger squeeze though nozzle 92. When delivering a squirt, the gun is calibrated to deliver exactly 0.5 ml. The gun also includes an output selector 94 to select whether a drop or squirt is to be delivered and a quantity as indicated by the flavor display 18 which instructs the operator to add a selected number of drops and/or squirts of each flavor, once the operator has added the flavors, the custom blend is complete.

Although the present invention has been described with reference to preferred embodiments, workers skilled in the art will recognize that changes may be made in form and detail without departing from the spirit and scope of the invention.

What is claimed:

1. A system for accurately dispensing small amounts of custom blended liquids for vaporizing in an electronic cigarette device comprising:

a housing having a liquid dispenser contained therein;

a liquid dispenser control unit positioned on or near the housing and in electronic communication with the liquid dispenser;

a processor configured for receiving, translating and transmitting at least one data input;

a first interactive display device for receiving at least one user input and transmitting the at least one user input to the processor;

a second and third interactive display device configured for receiving a translated data input from the processor;

wherein the liquid dispenser control unit is in wireless communication with the second interactive display device and the processor, the liquid dispenser comprising:

at least one container for holding a liquid component;

at least one dispensing spout for dispensing the at least one liquid component; and at least one pump for moving the at least one liquid component from the at least one container to the at least one dispensing spout; and a plurality of calibrated delivery devices for dispensing a liquid flavoring to the dispensed at least one liquid.

2. The system of claim 1 where the first interactive display device and the processor are in wireless communication with one another.

3. The system of claim 1 wherein the processor and the second interactive display are in wireless communication with one another.

4. The system of claim 1 wherein the processor and the third interactive display are in wireless communication with one another.

5. The system of claim 1 wherein at least one of the first, second and third interactive displays devices are touch-screen display devices for accepting inputs and displaying the inputs.

6. The system of claim 1 wherein the processor is configured to receive one or more user inputs from the first interactive display device.

7. The system of claim 6 wherein the processor is further configured to relay of the one or more user inputs received from the first interactive display device to at least one of the liquid dispenser control unit, the second interactive display device and third interactive display devices.

8. The system of claim 7 wherein the processor enables translation of the one or more inputs from the first interactive device and relay of the translated inputs to the second and third interactive devices.

9. The system of claim 8 wherein the liquid dispenser control unit is configured to accept the translated inputs from the processor for dispensing a selected amount of liquid from the at least one container to a selected spout.

10. The system of claim 9 wherein the at least one container further comprises at least two reservoirs for holding at least a first liquid and a second liquid, wherein the liquids are different.

11. The system of claim 1 wherein the plurality of calibrated delivery devices are separate and distinct devices, wherein each of the plurality of delivery devices holds a single liquid flavoring.

12. The system of claim 1 wherein the at least one container, at least one pump, at least one spout, the second interactive display device and the processor are disposed at least partially within the housing.

13. The system of claim 1 wherein the first interactive display device, the liquid dispenser, the third interactive display device and the calibrated delivery devices are each separate and distinct units, positionable away from one another.

* * * * *